US006688406B1

(12) United States Patent
Wu et al.

(10) Patent No.: US 6,688,406 B1
(45) Date of Patent: Feb. 10, 2004

(54) POWER TOOL HAVING A FUNCTION CONTROL MECHANISM FOR CONTROLLING OPERATION IN ONE OF ROTARY DRIVE AND HAMMERING MODES

(75) Inventors: Chien-Chun Wu, Taichung Hsien (TW); Hung-Ming Hsu, Taichung (TW); Cheng-I Teng, Taichung (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 0 days.

(21) Appl. No.: 10/455,006

(22) Filed: Jun. 5, 2003

(30) Foreign Application Priority Data

Jan. 29, 2003 (TW) ..... 92201759 U

(51) Int. Cl.[7] ..... B25D 11/04
(52) U.S. Cl. ..... 173/48; 173/109
(58) Field of Search ..... 173/48, 104, 109, 173/216, 47, 217, 205

(56) References Cited

U.S. PATENT DOCUMENTS

| | | | |
|---|---|---|---|
| 865,486 | A | 9/1907 | Gannon |
| 2,238,583 | A | 4/1941 | Dodge |
| 2,764,272 | A | 9/1956 | Reynolds |
| 2,968,960 | A | 1/1961 | Fulop |
| 3,252,303 | A | 5/1966 | Weasler et al. |
| 3,430,708 | A | 3/1969 | Miller |
| 3,730,281 | A | 5/1973 | Wood |
| 3,736,992 | A | 6/1973 | Zander et al. |
| 3,799,275 | A | 3/1974 | Plattenhardt et al. |
| 3,809,168 | A | 5/1974 | Formm |
| 3,834,468 | A | 9/1974 | Hettich et al. |
| 3,955,628 | A | 5/1976 | Grözinger et al. |
| 4,098,351 | A | 7/1978 | Alessio |
| 4,215,594 | A | 8/1980 | Workman, Jr. et al. |
| 4,274,304 | A | 6/1981 | Curtiss |
| 4,366,871 | A | 1/1983 | Dieterle et al. |
| 4,489,792 | A | 12/1984 | Fahim et al. |
| 4,522,270 | A | 6/1985 | Kishi |
| 4,567,950 | A | 2/1986 | Fushiya et al. |
| 4,585,077 | A | 4/1986 | Bergler |
| 4,823,885 | A | 4/1989 | Okumura |
| 4,895,212 | A | 1/1990 | Wache |
| 4,898,249 | A | 2/1990 | Ohmori |
| 4,986,369 | A | 1/1991 | Fushiya et al. |
| 5,005,682 | A | 4/1991 | Young et al. |
| 5,025,903 | A | 6/1991 | Elligson |

(List continued on next page.)

FOREIGN PATENT DOCUMENTS

| | | |
|---|---|---|
| DE | 405191 | 12/1965 |
| DE | 1478982 | 1/1970 |
| DE | 2438814 | 3/1976 |
| DE | 2715682 | 10/1978 |
| DE | 4004464 | 1/1991 |
| DE | 4038502 | 6/1992 |
| EP | 0399714 | 11/1990 |
| GB | 1346537 | 2/1974 |
| GB | 1366572 | 9/1974 |

*Primary Examiner*—Scott A. Smith
(74) *Attorney, Agent, or Firm*—Marshall, Gerstein & Borun LLP

(57) ABSTRACT

A power tool includes a function control mechanism to control operation of a drive spindle in a selected one of a rotary drive mode and a hammering mode. The function control mechanism includes a first ratchet that is mounted to rotate with the drive spindle, a second ratchet that is slidable from a first position to a second position, and a ring controller. The second ratchet is disengaged from the first ratchet when the second ratchet is in the first position, and is engaged with the first ratchet when the second ratchet is in the second position. The ring controller is coupled to a push ring that abuts against the second ratchet such that rotation of the ring controller results in movement of the second ratchet between the first and second positions.

7 Claims, 8 Drawing Sheets

U.S. PATENT DOCUMENTS 5,159,986 A 11/1992 Höser
5,343,961 A 9/1994 Ichikawa
5,449,043 A 9/1995 Bourner et al.
5,458,206 A 10/1995 Bourner et al.
5,704,433 A 1/1998 Bourner et al.
5,711,380 A * 1/1998 Chen ..... 173/109
5,842,527 A * 12/1998 Arakawa et al. ..... 173/104
6,142,242 A * 11/2000 Okumura et al. ..... 173/48
6,199,640 B1 * 3/2001 Hecht ..... 173/205
6,202,759 B1 3/2001 Chen
6,230,819 B1 * 5/2001 Chen ..... 173/48
RE37,905 E 11/2002 Bourner et al.
6,520,267 B2 * 2/2003 Funfer et al. ..... 173/48

* cited by examiner

POWER TOOL HAVING A FUNCTION CONTROL MECHANISM FOR CONTROLLING OPERATION IN ONE OF ROTARY DRIVE AND HAMMERING MODES

CROSS-REFERENCE TO RELATED APPLICATION

This application claims priority of Taiwanese application no. 092201759, filed on Jan. 29, 2003.

BACKGROUND OF THE INVENTION

1. Field of the Invention

The invention relates to a power tool, more particularly to a power tool having a function control mechanism for controlling operation in a selected one of a rotary drive mode and a hammering mode.

2. Description of the Related Art

A conventional power tool according to U.S. Pat. No. 5,458,206 includes a motor, a gear mechanism, a cylindrical housing, a drive spindle, and a function control mechanism. The gear mechanism is coupled to and is driven by the motor, and has a casing. The cylindrical housing is mounted on the casing of the gear mechanism. The drive spindle is mounted rotatably on the cylindrical housing, is coupled to and is driven rotatably by the gear mechanism, and is axially movable between front and rear limit positions relative to the cylindrical housing. The function control mechanism includes first and second ratchets, and a push ring. The first ratchet is mounted to rotate with the drive spindle. The second ratchet is slidable in the cylindrical housing from a first position to a second position. The push ring is disposed to abut against a rear surface of the second ratchet, and has a front surface that is formed with cam notches. The rear surface of the second ratchet is formed with cam knobs.

When the push ring is rotated so as to engage the cam notches and the cam knobs, this results in axial movement of the second ratchet to the first position. At this time, the first ratchet does not engage the second ratchet even when the drive spindle is moved axially to the rear limit position. As such, when a user presses a tool bit, which is secured on a front end of the drive spindle, against a workpiece, the drive spindle rotates without reciprocation.

When the push ring is rotated to disengage the cam notches and the cam knobs, this results in axial movement of the second ratchet to the second position. At this time, the first ratchet engages the second ratchet when the drive spindle is moved axially to the rear limit position. As such, when the user presses the tool bit against the workpiece, the drive spindle oscillates in axial movement, resulting in hammering action of the drive spindle.

The aforementioned conventional power tool achieves the purpose of switching between rotary drive and hammering modes of operation. However, the cam knobs of the second ratchet of the function control mechanism of the conventional power tool wear out easily due to frequent rotation of the push ring to engage and disengage the cam knobs and the cam notches, and the impact transmitted thereto during the hammering action of the drive spindle.

SUMMARY OF THE INVENTION

Therefore, the object of the present invention is to provide a power tool that has a function control mechanism, which can overcome the aforementioned drawback of the prior art.

According to the present invention, a power tool comprises a motor, a gear mechanism, a cylindrical housing, a drive spindle, and a function control mechanism. The gear mechanism is coupled to and driven by the motor, and has a casing. The cylindrical housing is mounted on the casing of the gear mechanism and is formed with a pair of diametrically opposite radial holes therethrough. The spindle mounting seat is disposed in the housing. The drive spindle is mounted rotatably on the spindle mounting seat, is coupled to and is driven rotatably by the gear mechanism, and is axially movable between front and rear limit positions relative to the spindle mounting seat. The function control mechanism includes a first ratchet, a second ratchet, a push ring, and a ring controller. The first ratchet is mounted to rotate with the drive spindle, and has front and rear surfaces. The rear surface of the first ratchet is formed with first ratchet teeth. The second ratchet is retained in the cylindrical housing, and has front and rear surfaces. The front surface of the second ratchet is formed with second ratchet teeth. The second ratchet is slidable in the cylindrical housing from a first position farther from the first ratchet to a second position closer to the first ratchet. The second ratchet teeth are disengaged from the first ratchet teeth when the second ratchet is in the first position. The second ratchet teeth are engaged with the first ratchet teeth when the second ratchet is in the second position and the drive spindle is in the rear limit position. The push ring is disposed in the cylindrical housing, abuts against the rear surface of the second ratchet, and has a pair of operable arms that extend radially and respectively through the radial holes in the cylindrical housing. The operable arms are movable between front and rear positions in the radial holes such that the second ratchet is in the first position when the operable arms are in the rear position, and such that the second ratchet is in the second position when the operable arms are in the front position. The ring controller is sleeved rotatably on the cylindrical housing, and is formed with a pair of circumferentially extending guide units. Each of the guide units is registered with a respective one of the radial holes in the cylindrical housing and is in sliding engagement with a respective one of the operable arms such that rotation of the ring controller relative to the cylindrical housing results in movement of the operable arms between the front and rear positions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
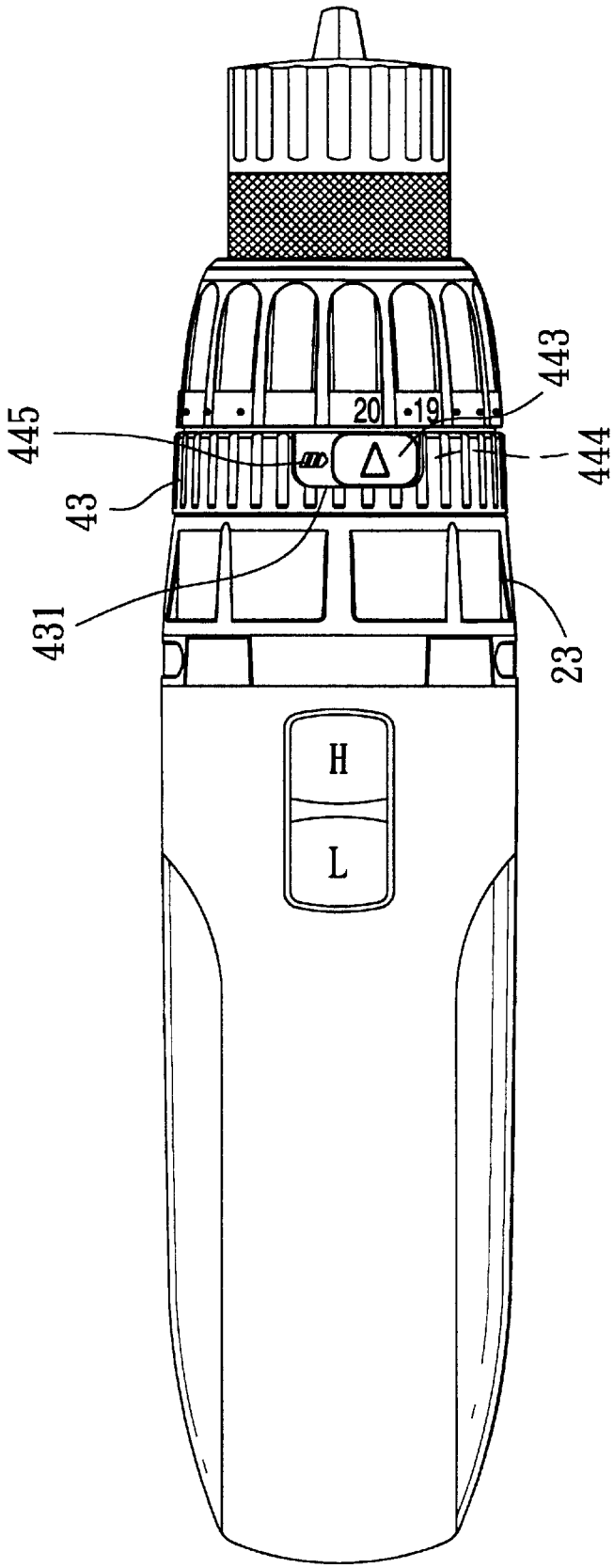
FIG. 1 is a schematic view of the preferred embodiment of a power tool according to the present invention.
Figure 2:
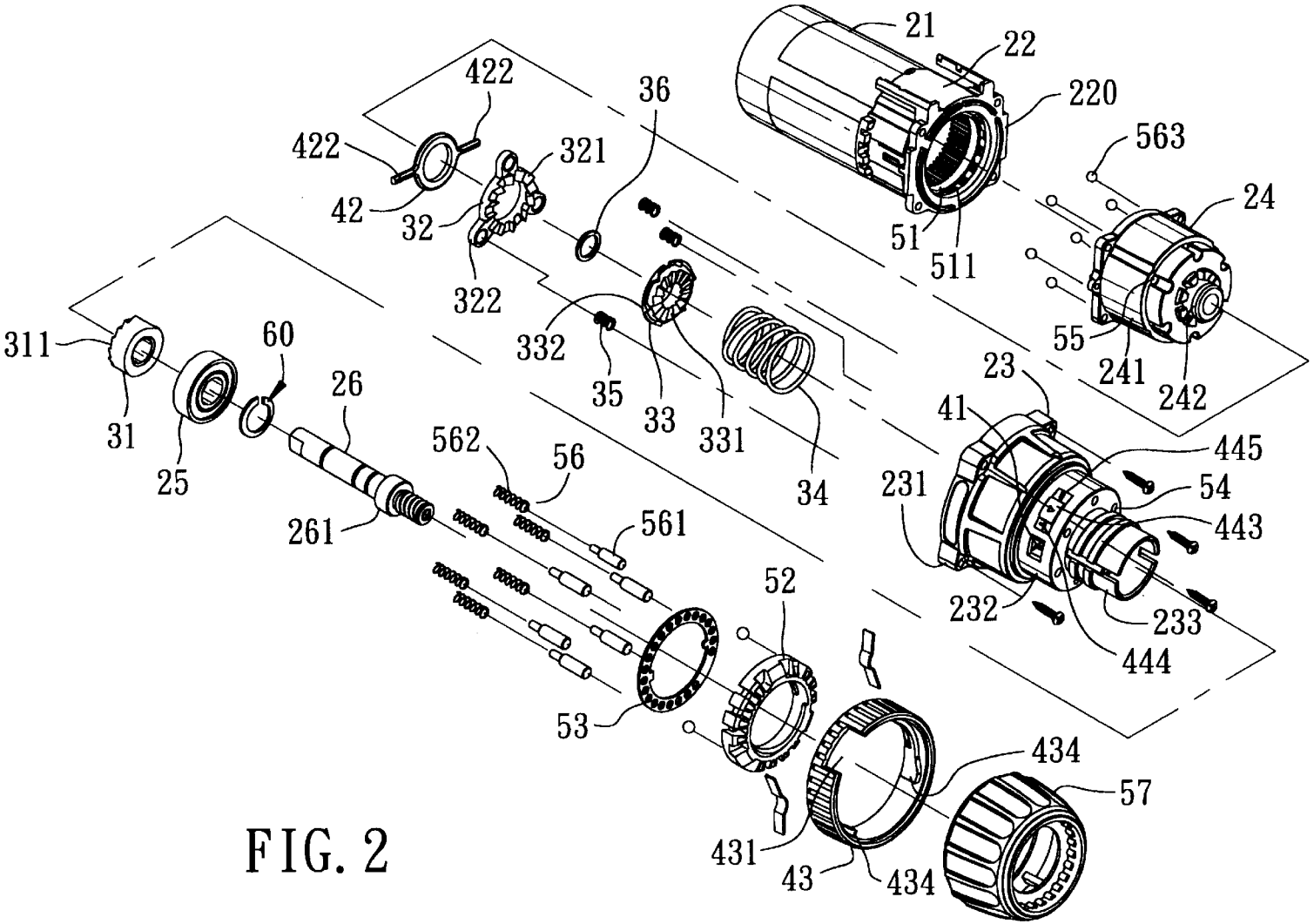
FIG. 2 is an exploded perspective view of the preferred embodiment.
Figure 3:
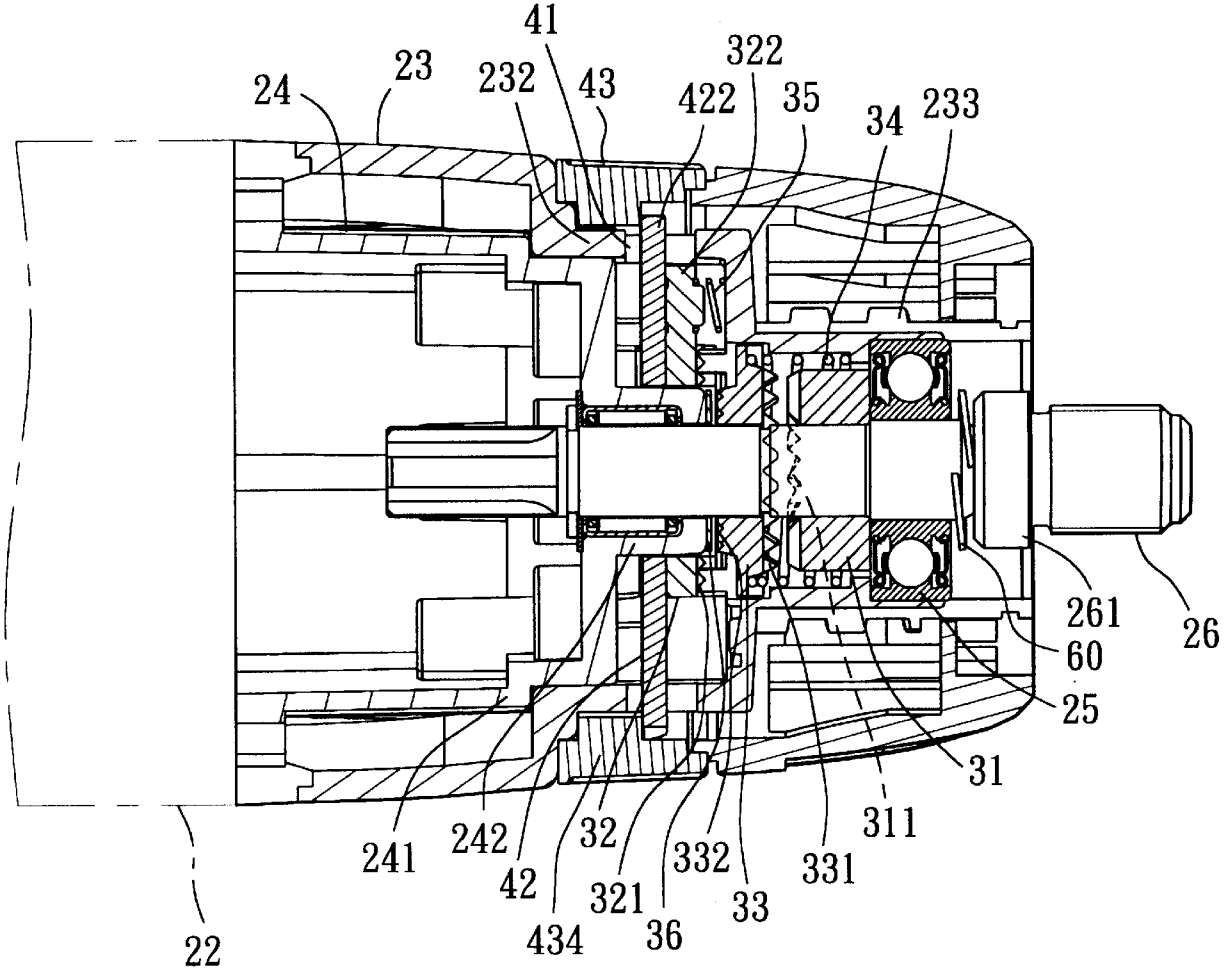
FIG. 3 is a fragmentary sectional view of the preferred embodiment in an assembled state illustrating a first ratchet being disengaged from a third ratchet, and a second ratchet disengaged being disengaged from the third ratchet.

Referring to FIGS. 1 to 3, the preferred embodiment of a power tool according to the present invention is shown to include a motor 21, a gear mechanism 22, a cylindrical housing 23, a spindle mounting seat 24, a drive spindle 26, and a function control mechanism.

The gear mechanism 22 is coupled to and is driven by the motor 21, has a casing 220, and includes a torque control ring 51 which permits the gear mechanism 22 to transmit torque when the torque control ring 51 is held stationary relative to the cylindrical housing 23, which disables torque transmission by the gear mechanism 22 when permitted to rotate relative to the cylindrical housing 23, and which has a castellated surface 511. Since the feature of the present invention does not reside in the particular configuration of the gear mechanism 22, which is conventional in construction, a detailed description of the same is omitted herein for the sake of brevity.

The cylindrical housing 23 is mounted on a front end of the casing 220 of the gear mechanism 22, and has a first end portion 231, a second end portion 233 opposite to the first end portion 231, and a middle portion 232 disposed between the first and second end portions 231, 233 of the cylindrical housing 23. The first end portion 231 of the cylindrical housing 23 is formed with a set of screw holes. The casing 220 is formed with a set of threaded holes corresponding to the screw holes in the cylindrical housing 23. Screw fasteners are inserted respectively through one of the screw holes in the first end portion 231 of the cylindrical housing 23 and threaded into the threaded holes in the casing 220. The second end portion 233 of the cylindrical housing 23 is formed with an external thread. The middle portion 232 of the cylindrical housing 23 is formed with a pair of diametrically opposite radial holes 41 therethrough, and has an outer surface that is provided with a first indicia 445, a second indicia 444, and a stop member 443 between the first and second indicia 445, 444.

The spindle mounting seat 24 is disposed in the cylindrical housing 23, and has first and second seat portions 241, 242. The first seat portion 241 of the spindle mounting seat 24 is disposed in the first end portion 231 of the cylindrical housing 23. The second seat portion 242 of the spindle mounting seat 24 extends from the first seat portion 241 and into the middle portion 232 of the cylindrical housing 23.

The drive spindle 26 is mounted rotatably on the second seat portion 242 of the spindle mounting seat 24, has a rear end that is coupled to and that is driven rotatably by the gear mechanism 22 in a conventional manner, has a front end that extends outwardly of the second end portion 233 of the cylindrical housing 23 and that is formed with an annular flange 261, and is axially movable between front and rear limit positions relative to the spindle mounting seat 24. The middle portion 232 of the cylindrical housing 23 is further formed with a set of axially extending actuator holes 54 that are angularly arranged around the drive spindle 26. The first seat portion 241 of the spindle mounting seat 24 is formed with a set of actuator holes 55 corresponding to the actuator holes 54 in the cylindrical housing 23.

A bearing member 25 is disposed in the cylindrical housing 23, and has an outer race that is secured to the second end portion 233 of the cylindrical housing 23 and an inner race that is sleeved on and that is in sliding engagement with the drive spindle 26. An urging member 60 has opposite ends abutting respectively against the bearing member 25 and the annular flange 261 of the drive spindle 26, and biases the drive spindle 26 to the front limit position.

The function control mechanism includes a first ratchet 31, a second ratchet 32, a push ring 42, and a ring controller 43.

The first ratchet 31 is mounted to rotate with the drive spindle 26, and has front and rear surfaces. The front surface of the first ratchet 31 abuts against the bearing member 25 when the drive spindle 26 is in the front limit position. The rear surface of the first ratchet 31 is formed with first ratchet teeth 311.

The second ratchet 32 is sleeved on the second seat portion 242 of the spindle mounting seat 24, is retained and is slidable in the cylindrical housing 23 from a first position farther from the first ratchet 31 to a second position closer to the first ratchet 31, and has front and rear surfaces. The front surface of the second ratchet 32 is formed with second ratchet teeth 321.

The push ring 42 is disposed in the cylindrical housing 23, is sleeved on the second seat portion 242 of the spindle mounting seat 24, abuts against the rear surface of the second ratchet 32, and has a pair of operable arms 422 that extend radially and respectively through the radial holes 41 in the middle portion 232 of the cylindrical housing 23. The operable arms 422 are movable between front and rear positions in the radial holes 41 such that the second ratchet 32 is in the first position when the operable arms 422 are in the rear position, and such that the second ratchet 32 is in the second position when the operable arms 422 are in the front position.

The ring controller 43 is sleeved rotatably on the middle portion 232 of the cylindrical housing 23, is formed with a pair of circumferentially extending guide units 434, and has a notched portion 431. Each of guide units 434 is registered with a respective one of the radial holes 41 in the cylindrical housing 23 and has a cam surface that is in sliding engagement with a respective one of the operable arms 422 such that rotation of the ring controller 43 relative to the cylindrical housing 23 results in movement of the operable arms 422 between the front and rear positions. The notched portion 431 receives the stop member 443 and has a size sufficient to conceal one of the first and second indicia 445, 444 and to expose the other one of the first and second indicia 445, 444. Accordingly, disposition of the second ratchet 32 in the first or second position can be indicated by the exposed one of the first and second indicia 445, 444.

The function control mechanism further includes a third ratchet 33, a biasing member 34, a washer 36, a biasing unit 35, and a torque adjusting unit.

The third ratchet 33 is sleeved on the drive spindle 26, is disposed between the first and second ratchets 31, 32, and has a front surface formed with third ratchet teeth 331 and a rear surface formed with fourth ratchet teeth 332.

Figure 7:
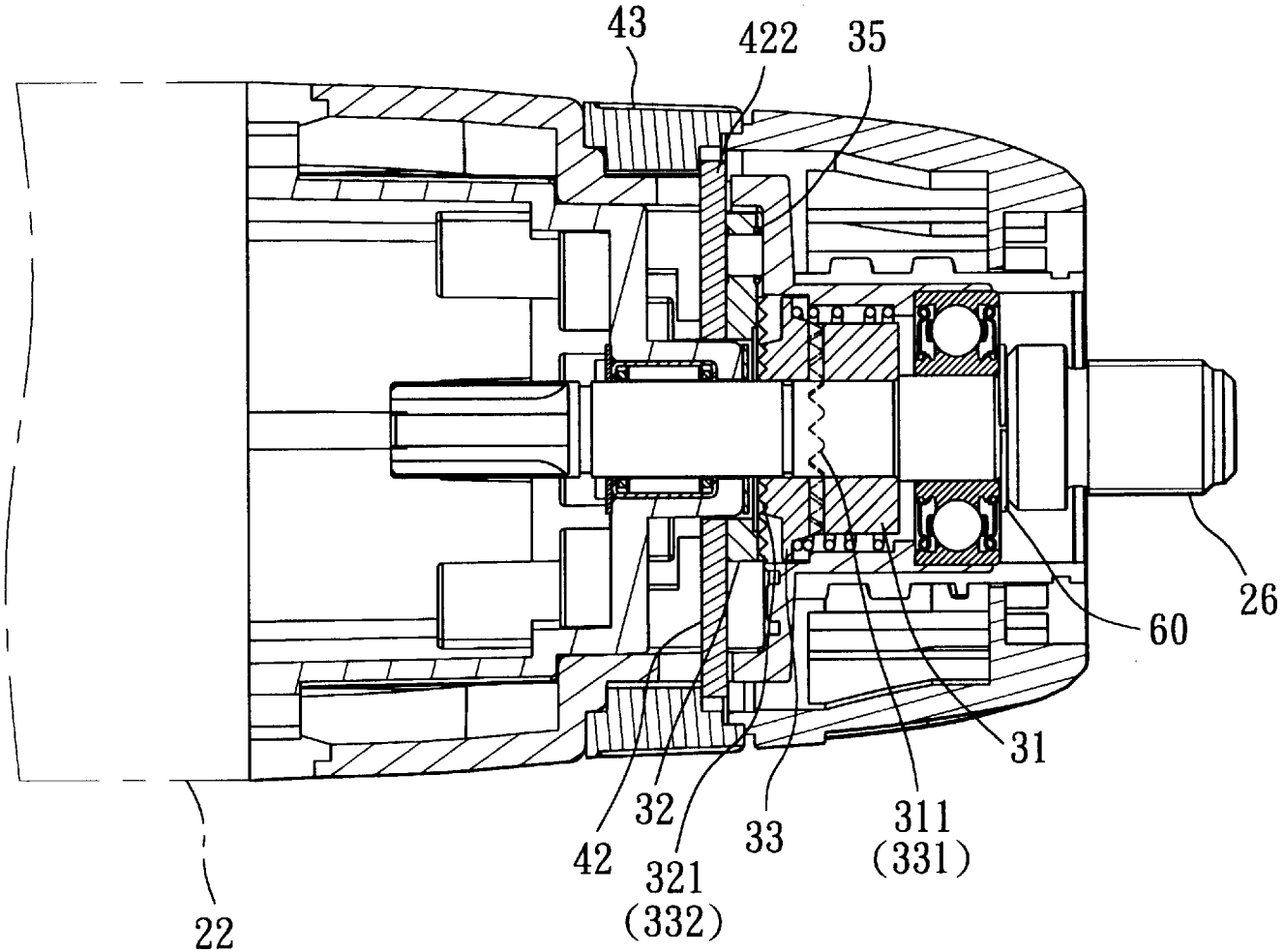
FIG. 7 is a fragmentary sectional view of the preferred embodiment in the assembled state illustrating the first ratchet engaging the third ratchet, and the second ratchet engaging the third ratchet.

As best shown in FIG. 3, the second ratchet teeth 321 are disengaged from the third ratchet 33, and thus the first ratchet teeth 311, when the second ratchet 32 is in the first position. As best shown in FIG. 7, the second ratchet teeth 321 engage indirectly the first ratchet teeth 311 through the third ratchet 33 when the second ratchet 32 is in the second position and the drive spindle 26 is in the rear limit position.

The biasing member 34 is sleeved on the first ratchet 31, and has opposite ends that abut respectively against the third ratchet 33 and the second end portion 233 of the cylindrical housing 23 to bias the third ratchet 33 toward the second ratchet 32.

The washer 36 is sleeved on the drive spindle 26 and is disposed at a front end of the second seat portion 242 of the spindle mounting seat 24 so as to abut against the fourth ratchet teeth 332 when the fourth ratchet teeth 332 disengage from the second ratchet teeth 321. As such, the friction between the second seat portion 242 of the spindle mounting seat 24 and the fourth ratchet teeth 332 can be reduced when the second ratchet 32 is in the first position.

The biasing unit 35 is used for biasing the second ratchet 32 to the first position. In this embodiment, the second ratchet 32 is formed with three radial lugs 322. The cylindrical housing 23 is formed with grooves (not visible) that receive the lugs 322 of the second ratchet 32 and that prevent rotation of the second ratchet 32 in the cylindrical housing 23. The biasing unit 35 has opposite ends that abut respectively against the lugs 322 of the second ratchet 32 and the grooves in the cylindrical housing 23.

Figure 4:
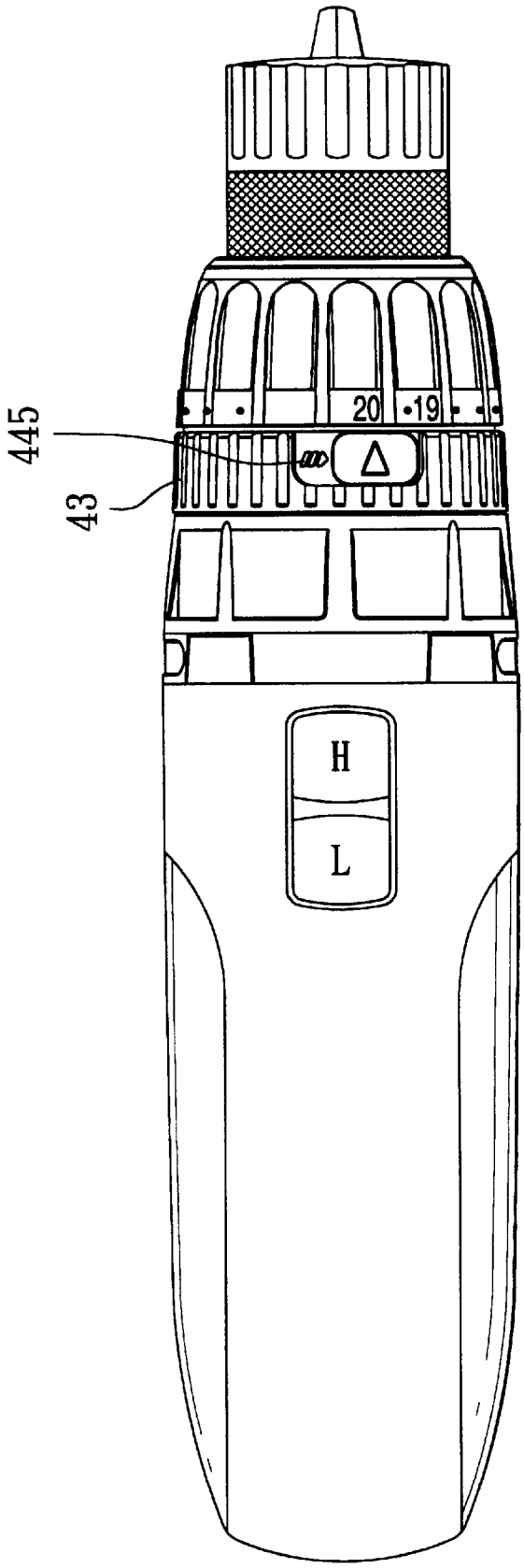
FIG. 4 is a schematic view of the preferred embodiment illustrating a ring controller rotated for operation in a rotary drive mode.
Figure 5:
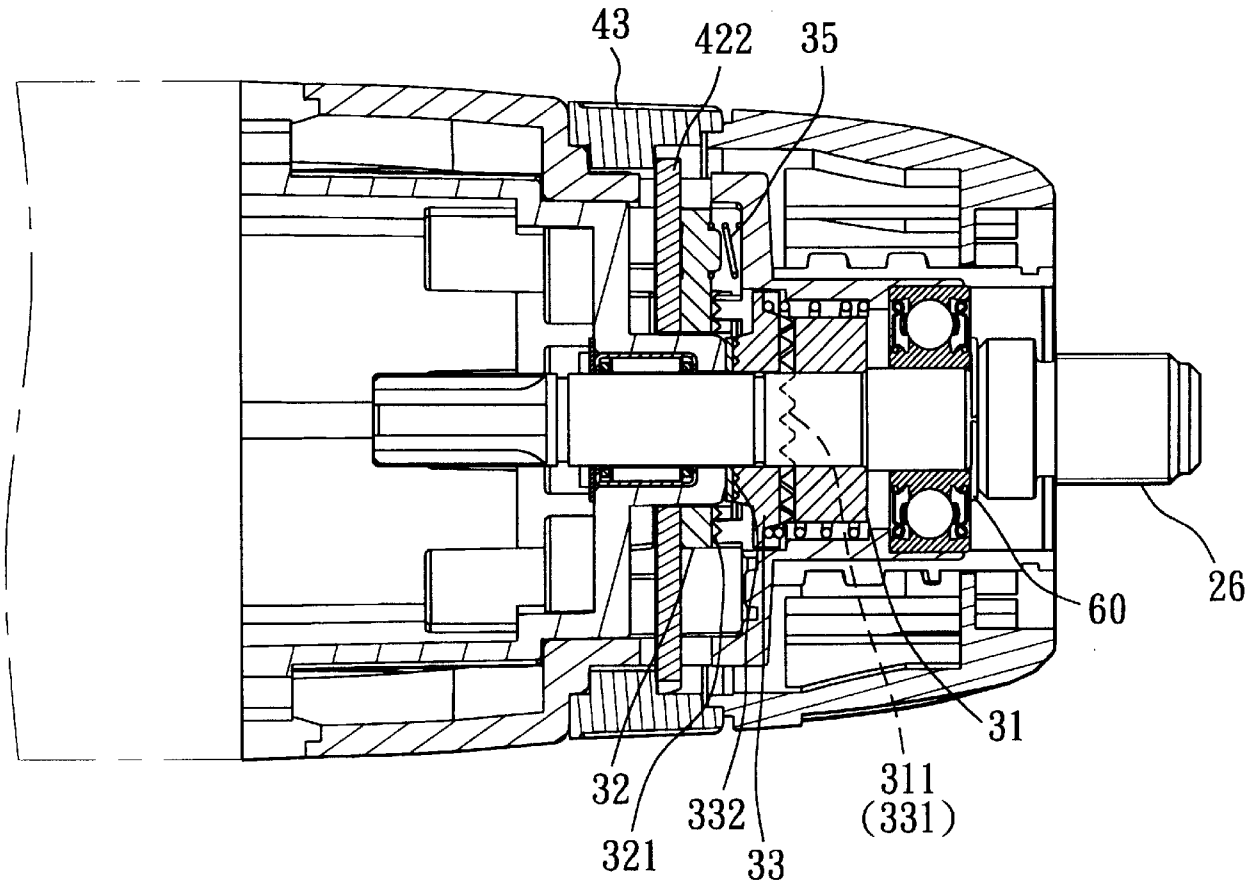
FIG. 5 is a fragmentary sectional view of the preferred embodiment in the assembled state illustrating the first ratchet engaging the third ratchet, and the second ratchet being disengaged from the third ratchet.

As illustrated in FIGS. 3 and 4, when the ring controller 43 is rotated such that the first indicia 445, which indicates operation in a rotary drive mode, is exposed, this results in corresponding axial movement of the operable arms 422 to the rear position, and in axial movement of the second ratchet 32 to the first position due to the biasing action of the biasing unit 35. At this time, the fourth ratchet teeth 332 are disengaged from the second ratchet teeth 321, and the urging member 60 biases the drive spindle 26 to the front limit position such that third ratchet teeth 331 are disengaged from the first ratchet teeth 311. In this position, operation of the motor 21 (see FIG. 2) results in axial rotation of the drive spindle 26. Thereafter, when the user presses a tool bit (not shown), which is secured on a front end of the drive spindle 26, against a workpiece (not shown), the urging member 60 is compressed, the drive spindle 26 moves axially to the rear limit position, and the third ratchet teeth 331 engage the first ratchet teeth 311, as best shown in FIG. 5. As such, when the motor 21 operates, the third ratchet 33 rotates together with the first ratchet 31 so that the drive spindle 26 rotates without reciprocation.

Figure 6:
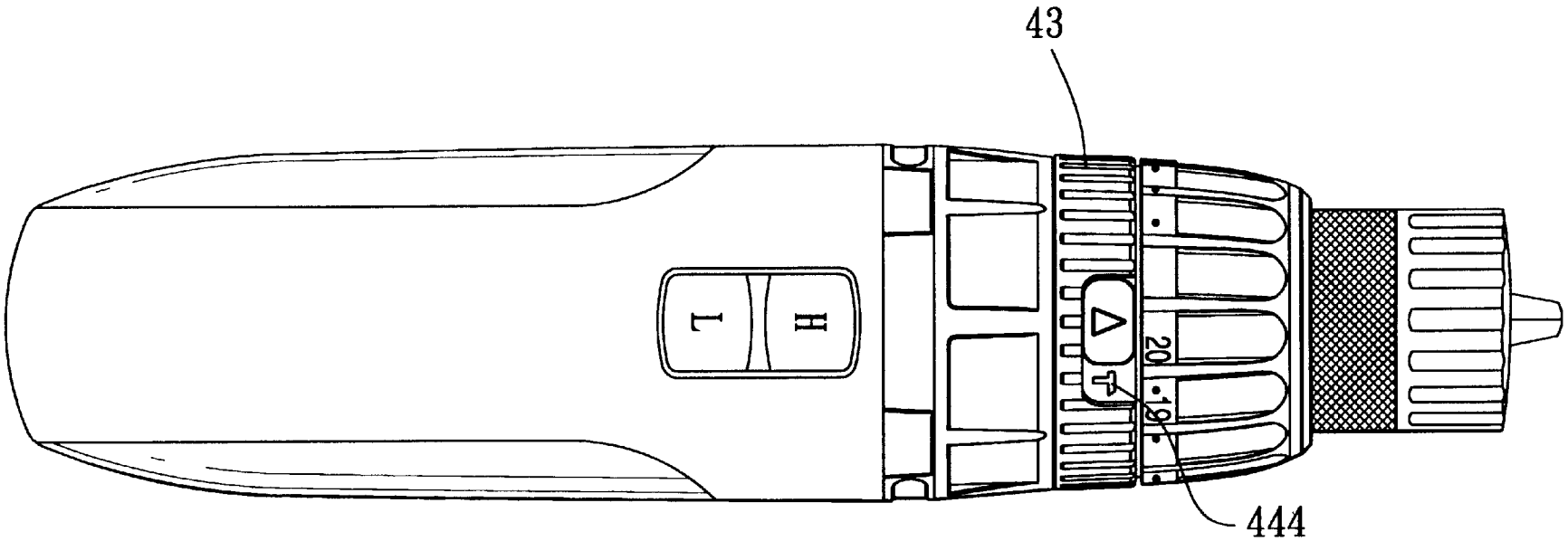
FIG. 6 is a schematic view of the preferred embodiment illustrating the ring controller rotated for operation in a hammering mode.

As illustrated in FIGS. 6 and 7, when the ring controller 43 is rotated such that the second indicia 444, which indicates operation in a hammering mode, is exposed, this results in corresponding axial movement of the operable arms 422 to the front position, in axial movement of the second ratchet 32 to the second position due to the pushing action of the push ring 42, in compression of the biasing unit 35, and in engagement between the fourth and second ratchet teeth 332, 321. At this time, the third ratchet teeth 331 are disengaged from the first ratchet teeth 311 until the user presses the tool bit against the workpiece. Until such time, however, operation of the motor 21 (see FIG. 2) still results in axial rotation of the drive spindle 26. By the time the user presses the tool bit (not shown) against the workpiece (not shown), the urging member 60 is compressed, the drive spindle 26 moves axially to the rear limit position, and the third ratchet teeth 331 engage the first ratchet teeth 311. As such, when the motor 21 operates, the third ratchet 33 does not rotate together with the first ratchet 31 due to engagement between the second and third ratchets 32, 33 so that an oscillating axial movement is imparted on the drive spindle 26, thus, resulting in hammering action of the drive spindle 26.

Figure 8:
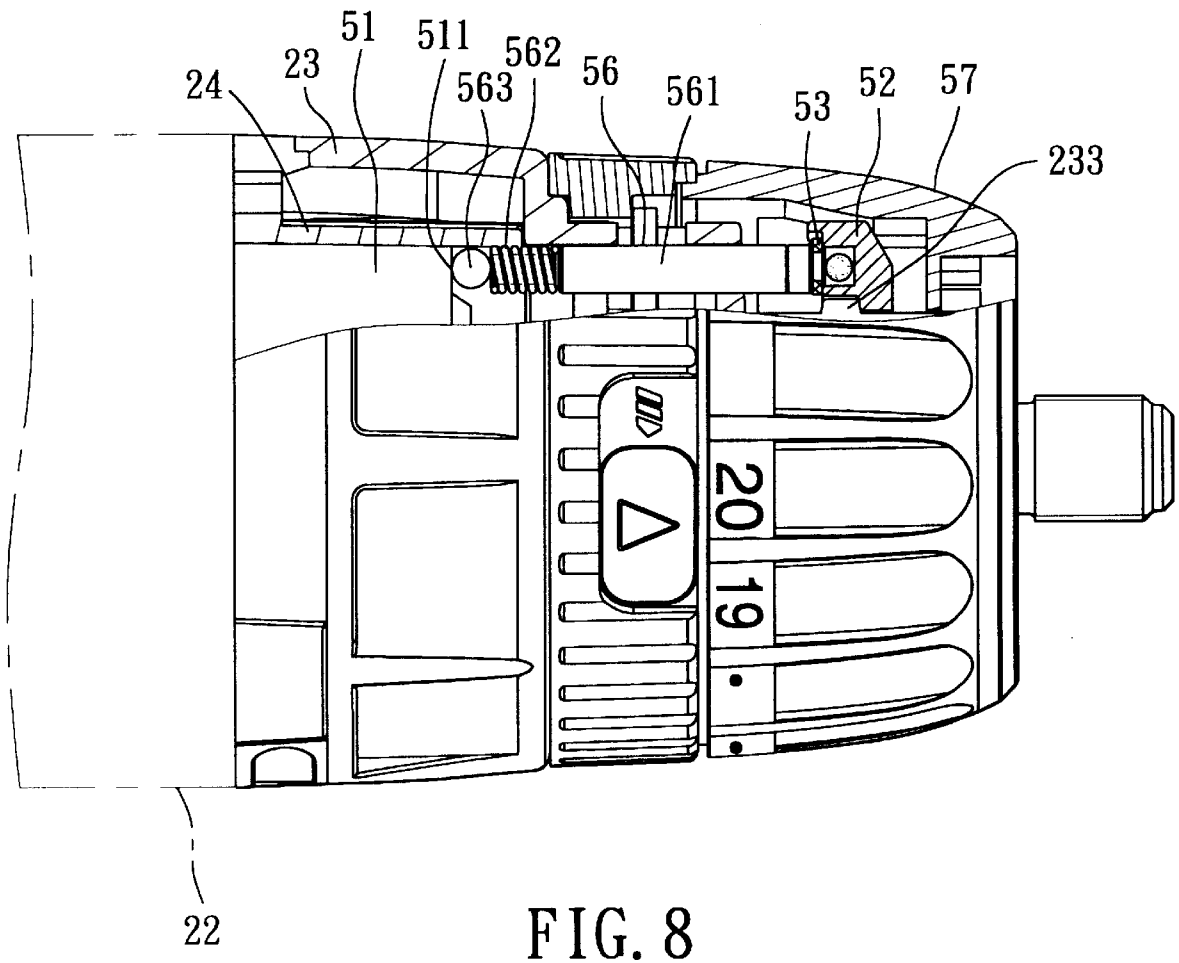
FIG. 8 is a fragmentary sectional view of the preferred embodiment to illustrate a torque adjusting unit thereof.

Referring back in FIG. 2 and with further reference in FIG. 8, the torque adjusting unit includes a set of spring-loaded actuators 56, an abutment ring 53, and a torque adjusting ring 52.

Each of the spring-loaded actuators 56 is disposed in one of the actuator holes 55 in the first seat portion 241 of the spindle mounting seat 24, and has a first end that extends through one of the actuator holes 54 in the middle portion 232 of the cylindrical housing 23 and a second end that engages the castellated surface 511 of the torque control ring 51 in the casing 220 of the gear mechanism 22.

The abutment ring 53 is disposed adjacent to the middle portion 232 of the cylindrical housing 23 and engages the first ends of the spring-loaded actuators 56.

Preferably, each of the spring-loaded actuators 56 includes a pin 561 that engages the abutment ring 53, a ball 563 that engages the castellated surface 511 of the torque control ring 51, and a spring 562 that has opposite ends that engage the pin 561 and the ball 563.

The torque adjusting ring 52 is mounted threadedly on the second end portion 233 of the cylindrical housing 23 and abuts against the abutment ring 53. The construction as such permits rotation of the torque adjusting ring 52 to result in axial displacement of the abutment ring 53 to vary spring force of the springs 562 of the spring-loaded actuators 56, thereby controlling the torque transmission by the gear mechanism 22. Further, to conveniently rotate the torque adjusting ring 52, a control knob 57 may be sleeved securely on the torque control ring 52.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A power tool comprising:

a motor;

a gear mechanism coupled to and driven by said motor, said gear mechanism having a casing;

a cylindrical housing mounted on said casing of said gear mechanism and formed with a pair of diametrically opposite radial holes therethrough;

a spindle mounting seat disposed in said housing;

a drive spindle mounted rotatably on said spindle mounting seat and coupled to and driven rotatably by said gear mechanism, said drive spindle being axially movable between front and rear limit positions relative to said spindle mounting seat; and a function control mechanism including a first ratchet mounted to rotate with said drive spindle, and having front and rear surfaces, said rear surface of said first ratchet being formed with first ratchet teeth, a second ratchet retained in said cylindrical housing, and having front surface and rear surfaces, said front surface of said second ratchet being formed with second ratchet teeth, said second ratchet being slidable in said cylindrical housing from a first position farther from said first ratchet to a second position closer to said first ratchet, said second ratchet teeth being disengaged from said first ratchet teeth when said second ratchet is in the first position, said second ratchet teeth being engaged with said first ratchet teeth when said second ratchet is in the second position and said drive spindle is in the rear limit position, a push ring disposed in said cylindrical housing and abutting against said rear surface of said second ratchet, said push ring having a pair of operable arms that extend radially and respectively through said radial holes in said cylindrical housing, said operable arms being movable between front and rear positions in said radial holes such that said second ratchet is in the first position when said operable arms are in the rear position, and such that said second ratchet is in the second position when said operable arms are in the front position, and a ring controller sleeved rotatably on said cylindrical housing, said ring controller being formed with a pair of circumferentially extending guide units, each of which is registered with a respective one of said radial holes in said cylindrical housing and is in sliding engagement with a respective one of said operable arms such that rotation of said ring controller relative to said cylindrical housing results in movement of said operable arms between the front and rear positions.

2. The power tool as claimed in claim 1, wherein said function control mechanism further includes:

a third ratchet sleeved on said drive spindle and disposed between said first and second ratchets, said third ratchet having a front surface formed with third ratchet teeth, and a rear surface formed with fourth ratchet teeth, and a biasing member for biasing said third ratchet toward said second ratchet, said third ratchet teeth being disengaged from said first ratchet teeth when said drive spindle is in the front limit position, said fourth ratchet teeth being disengaged from said second ratchet teeth when said second ratchet is in the first position, when said second ratchet is in the second position and said drive spindle is in the rear limit position, said third ratchet teeth engaging said first ratchet teeth, and said fourth ratchet teeth engaging said second ratchet teeth.

3. The power tool as claimed in claim 2, wherein said function control mechanism further includes a washer sleeved on said drive spindle and disposed to abut against said fourth ratchet teeth when said fourth ratchet teeth disengages from said second ratchet teeth.

4. The power tool as claimed in claim 1, wherein said function control mechanism further includes a biasing unit for biasing said second ratchet to the first position.

5. The power tool as claimed in claim 1, further comprising:

a bearing member having an outer race secured to said cylindrical housing and an inner race sleeved on and in sliding engagement with said drive spindle; and an urging member having opposite ends abutting respectively against said bearing member and said drive spindle, said urging member biasing said drive spindle to the front limit position.

6. The power tool as claimed in claim 1, wherein:

said cylindrical housing has an outer surface provided with first and second indicia and a stop member between said first and second indicia, said ring controller having a notched portion that receives said stop member and that has a size sufficient to conceal one of said first and second indicia and to expose the other one of said first and second indicia;

whereby, disposition of said second ratchet in the first or second position is indicated by the exposed one of said first and second indicia.

7. The power tool as claimed in claim 1, wherein said gear mechanism includes a torque control ring which permits said gear mechanism to transmit torque when said torque control ring is held stationary relative to said cylindrical housing, and which disables torque transmission by said gear mechanism when permitted to rotate relative to said cylindrical housing, said torque control ring having a castellated surface, said cylindrical housing being formed with a set of axially extending actuator holes that are angularly arranged around said drive spindle, said spindle mounting seat being formed with a set of actuator holes corresponding to said actuator holes in said cylindrical housing, said function control mechanism further including a torque adjusting unit, said torque adjusting unit including a set of spring-loaded actuators, each of which is disposed in one of said actuator holes in said spindle mounting seat and has a first end that extends through one of said actuator holes in said cylindrical housing, and a second end that engages said castellated surface of said torque control ring, an abutment ring disposed adjacent to said cylindrical housing and engaging said first ends of said spring-loaded actuators, and a torque adjusting ring mounted threadedly on said cylindrical housing and abutting against said abutment ring, wherein each of said spring-loaded actuators includes a pin that engages said abutment ring, a ball that engages said torque control ring, and a spring having opposite ends that engage said pin and said ball, wherein rotation of said torque adjusting ring results in axial displacement of said abutment ring to vary spring force of said springs of said spring-loaded actuators, thereby controlling the torque transmission by said gear mechanism.

* * * * *